US005470639A

United States Patent [19]

Gessner et al.

[11] Patent Number: 5,470,639

[45] Date of Patent: Nov. 28, 1995

[54] ELASTIC NONWOVEN WEBS AND METHOD OF MAKING SAME

[75] Inventors: Scott L. Gessner, Encinitas, Calif.; David D. Newkirk, Greer, S.C.; Michael M. Thomason, Simpsonville, S.C.; James O. Reeder, Greenville, S.C.

[73] Assignee: Fiberweb North America, Inc., Simpsonville, S.C.

[21] Appl. No.: 829,923

[22] Filed: Feb. 3, 1992

[51] Int. Cl.[6] ..... A61F 13/46; B32B 5/04; B32B 5/26; B32B 31/08; D04H 3/16

[52] U.S. Cl. ..... 428/152; 156/62.4; 156/161; 156/176; 156/181; 156/229; 156/309.3; 428/286; 428/287; 428/288; 428/296; 428/302; 604/366; 604/370; 604/372; 604/378; 604/385.2

[58] Field of Search ..... 428/296, 288, 428/152, 286, 287, 302; 156/62.4, 161, 176, 181, 229, 309.3; 604/385.2

[56] References Cited

U.S. PATENT DOCUMENTS

| | | | |
|---|---|---|---|
| 3,117,055 | 1/1964 | Guandique et al. . | |
| 3,949,128 | 4/1976 | Ostermeier | 428/296 |
| 4,209,563 | 6/1980 | Sisson | 428/288 |
| 4,296,163 | 10/1981 | Emi et al. . | |
| 4,657,802 | 4/1987 | Morman | 428/296 |
| 5,116,662 | 5/1992 | Morman | 428/286 |
| 5,169,706 | 12/1992 | Collier et al. | 428/296 |
| 5,260,126 | 11/1993 | Collier et al. | 428/288 |
| 5,296,289 | 3/1994 | Collins | 428/296 |
| 5,324,576 | 6/1994 | Reed et al. | 428/288 |
| 5,324,580 | 6/1994 | Allan et al. | 428/296 |
| 5,332,613 | 7/1994 | Taylor et al. | 428/288 |
| 5,336,545 | 8/1994 | Morman | 428/296 |
| 5,366,793 | 11/1994 | Fitts et al. | 428/288 |
| 5,385,775 | 1/1995 | Wright | 428/296 |
| 5,405,682 | 4/1995 | Shawyer et al. | 428/288 |

FOREIGN PATENT DOCUMENTS

| | | |
|---|---|---|
| 0342927A2 | 11/1989 | European Pat. Off. . |
| 0416379A2 | 3/1991 | European Pat. Off. . |
| WO87/05952 | 10/1987 | WIPO . |
| WO90/03258 | 4/1990 | WIPO . |

*Primary Examiner*—James C. Cannon
*Attorney, Agent, or Firm*—Bell, Seltzer, Park & Gibson

[57] ABSTRACT

A spunbonded elastic nonwoven fabric comprises a web of bonded thermoplastic filaments of a thermoplastic elastomer. The spunbonded fabrics of the invention are prepared in a slot draw spunbonding process operated at a rate of less than about 2000 meters per minute. The elastic fabric is used in absorbent products, such as disposable diapers, adult incontinence pads, sanitary napkins and the like, and as coverstock for absorbent personal care products.

55 Claims, 1 Drawing Sheet

ELASTIC NONWOVEN WEBS AND METHOD OF MAKING SAME

FIELD OF THE INVENTION

The present invention relates to an elastic nonwoven fabric comprised of a web of bonded thermoplastic spunbonded filaments of a thermoplastic elastomer and to absorbent products, such as disposable diapers, adult incontinence pads and sanitary napkins, and to a coverstock for absorbent personal care products.

BACKGROUND OF THE INVENTION

The manufacture of nonwoven webs has become a substantial part of the textile industry. There are a wide variety of uses for nonwoven webs, including the manufacture of surgical drapes, wiping cloths, carpets and components of disposable products such as diapers and sanitary napkins.

It is often desirable to incorporate an elastomeric web into a nonwoven fabric, particularly for nonwoven fabrics used in disposable garment and personal care products. Stretchable fabrics are desirable for use as components in these products because of their ability to conform to irregular shapes and to allow more freedom of body movements than do fabrics with limited extensibility.

There are a wide variety of techniques for producing nonwoven webs. Elastic nonwoven webs have been produced, for example, by meltblowing techniques. In meltblowing, thermoplastic resin is fed into an extruder where it is melted and heated to the appropriate temperature required for fiber formation. The extruder feeds the molten resin to a special melt-blowing die. The die arrangement is generally a plurality of linearally arranged small diameter capillaries. The resin emerges from the die orifices as molten threads into a high velocity stream of gas, usually air. The air attenuates the polymer into a blast of fine fibers which are collected on a moving screen placed in front of the blast. As the fibers land on the screen, they entangle to form a cohesive web. Meltblowing forms very small diameter fibers, typically about two micrometers in diameter and several inches in length, which entangle in the web sufficiently so that it is generally impossible to remove one complete fiber from the mass of fibers or to trace one fiber from beginning to end.

Elastic meltblown webs exhibit a number of desirable properties. For example, the webs have good integrity due primarily to the fiber entanglement and surface attraction between the very small fibers. There are, in addition, advantages inherent in the meltblowing process itself. For example, the fibers are collected at a relatively short distance from the die, usually ranging from 12 to 6 inches, giving a positive control of the fiber blast and good edge control. Further, meltblowing can tolerate non-uniform polymer melts and mixtures of polymers which cannot be handled by other processes. A variety of polymers can be used in melt-blowing techniques, and in fact, melt blowing is said to be applicable to any fiber forming material that can give an acceptably low melt viscosity at suitable processing temperatures and which will solidify before landing on the collector screen.

Despite all of the advantages of meltblowing, however, there are several disadvantages to this technique for producing elastic nonwoven webs. The technique is inherently costly. The die configuration, essential to the production of meltblown fibers, requires a side-by-side arrangement of spinneret orifices. This limits the number of spinnerets that can be set up for production within a given area, which in turn limits both efficient use of floor space and the possible output of fibers. Further, preparing and monitoring the spinnerets is labor-intensive.

Meltblown webs are only moderately strong due to processing conditions. The meltblown polymer is molten during the entire fiber formation process, and due to the relatively short relaxation time of meltblown polymers, meltblown filaments typically are not highly oriented. Without the molecular alignment that occurs during more conventional fiber attenuation, and which lends strength to the fibers, the properties of elastic polymers are not optimized in meltblowing.

Meltblown webs also have less desirable aesthetic appeal. The noncontinuous network of fibers can give an unpleasant feel or "hand." Further, the network of fibers can snag and fiber shedding can be a problem.

There have been attempts to use the well known spinbonding process to produce elastic nonwoven fabrics. Various spinbonding techniques exist, but all include the basic steps of: extruding continuous filaments, quenching the filaments, drawing or attenuating the filaments by a high velocity fluid, and collecting the filaments on a surface to form a web. Spunbonded webs can have a more pleasant feel than meltblown webs because they more closely approximate textile filament deniers and consequently textile-like drape and hand.

One difference in the various spinbonding processes is the attenuation device. For example, in the Lurgi spinbonding process, multiple round or tube-shaped devices attenuate the filaments. A spinneret extrudes a molten polymer as continuous filaments. The filaments are attenuated as they exit the spinneret and are quenched, or solidified, by a flow of air. The filaments then enter the round attenuator gun where they are entrained with large quantities of high pressure air which provide the attenuation force for the filaments. As the filaments and air exit the gun, they move with an expanding supply of air to form a cone or a fan of separated filaments, which are deposited on a forming wire.

The use of round attenuator guns results in several problems. Tube-type attenuators consume large quantities of high pressure air, resulting in high utility costs and high noise levels. Additionally, these type attenuators must be individually strung up and monitored. If a filament breaks, the ends tend to plug the attenuator; the process must be stopped, the hole unplugged, and the filaments rethreaded. All of this results in decreased efficiency and increased labor.

Various slot draw processes have been developed to overcome the problems of the Lurgi process. In slot drawing the multiple tube attenuators are replaced with a single slot-shaped attenuator which covers the full width of the machine. A supply of air is admitted into the slot attenuator below the spinneret face with or without a separate quench step. The air proceeds down the attenuator channel, which narrows in width in the direction away from the spinneret, creating a venturi effect, and causing filament attenuation. The air and filaments exit the attenuator channel and are collected on the forming wire. The attenuation air, depending on the type of slot draw process used, can be directed into the attenuation slot by a pressurized air supply above the slot, or by a vacuum located below the forming wire.

Slot drawing has various advantages over the Lurgi process. The slot attenuator is self-threading in that the filaments fall out of the spin block directly into the slot attenuator. The high pressure air used by Lurgi devices is not always required, thereby reducing noise and utility costs. Further, the slot draw machines are practically plug-free. However, both the Lurgi and slot draw processes provide advantageous economics as compared to the melt blowing process.

In view of the advantages of the spinbonding processes, it would be desirable to provide elastic nonwovens by spinbonding. Attempts to impart elasticity to spunbonded fabrics, however, have been largely unsuccessful. One problem is breakage, or elastic failure, of the filaments during extrusion and drawing. Due to the stretch characteristics of elastomeric polymers, the filaments tend to snap and break while being attenuated in the molten or partially hardened state. If a filament breaks during production, the ends of the broken filament can either clog the flow of filaments or enmesh the other filaments, resulting in a mat of tangled filaments in the nonwoven web. Severe filament breaks manifest themselves as polymer droplets which are conveyed to the forming wire in the molten state causing tear outs and wire wraps.

SUMMARY OF THE INVENTION

Elastic spunbonded fabrics having a root mean square (RMS) recoverable elongation of at least about 75% in both the machine direction (MD) and the cross direction (CD) after 30% elongation and one pull, and preferably at least about 70% after two pulls, are provided in accordance with the invention. The spunbonded fabrics of the invention are preferably prepared by conducting the spunbonding process at a rate of less than 2000 meters per minute, e.g., less than 1500 m/min. employing an elastomeric thermoplastic.

In one preferred aspect of the invention, a nonwoven fabric having superior elastic and aesthetic properties is produced by melt spinning substantially continuous filaments of a thermoplastic olefin-based elastomer. Advantageously, the elastomer is a primarily crystalline olefin, heterophasic copolymer. This copolymer includes a crystalline base polymer fraction, i.e., block, and an amorphous copolymer fraction or block with elastic properties as a second phase blocked to the crystalline base polymer fraction via a semi-crystalline polymer fraction.

Advantageously the elastic spunbonded fabric is prepared by extruding an elastomer through a die or a spinneret in a low speed slot draw spunbonding process in which the filaments are quenched, attenuated by a fluid, and collected as a web of bonded filaments. Bonding can be accomplished during collection or as a separate step. Advantageously, the filaments are extruded at a temperature of at least about 20° C. above the melt temperature of the elastomer and are subsequently quenched at temperatures in the range of about 5° C. to 80° C., drawn by high velocity air, and collected as a mat or nonwoven web at speeds in the range of about 100 to about 2000 meters per minute, preferably 200 to 1500 meters per minute.

The invention also provides elastic nonwoven products in which the elastic spunbonded web is provided as a component, such as a layer, in a disposable diaper. In one embodiment of this aspect, the web is stretched to at least 10% beyond its original length and given barrier properties, for example, by laminating the web to a liquid impermeable film. The web is then incorporated as a backsheet or leg cuff layer into a diaper having a plurality of layers. SMS (spunbond/meltblown/spunbond) medical laminates having elastic properties are also provided in accordance with the invention.

The elastic nonwoven fabrics produced in accordance with this invention can have various benefits and advantages. As compared to meltblown elastic webs, the elastic spunbonded webs of the invention can have improved aesthetic and strength properties and can be produced more economically. As compared to prior spunbonded webs, the elastic spunbonded webs of the invention can be manufactured while minimizing or eliminating the known problems associated with previous attempts in spunbonding of elastic polymers, such as breakage, the inherent resistance to processing of such polymers, wire wraps, polymer drips, and tear outs. The preferred olefin based thermoplastic primarily crystalline heterophasic copolymer compositions used to produce fabrics of the invention eliminate problems encountered in prior attempts to process elastic polymers, such as their inherent resistance to processing, allowing higher outputs of the fabric.

BRIEF DESCRIPTION OF THE DRAWINGS

In the drawings which form a portion of the disclosure of the invention.

DETAILED DESCRIPTION OF THE INVENTION

Figure 1:
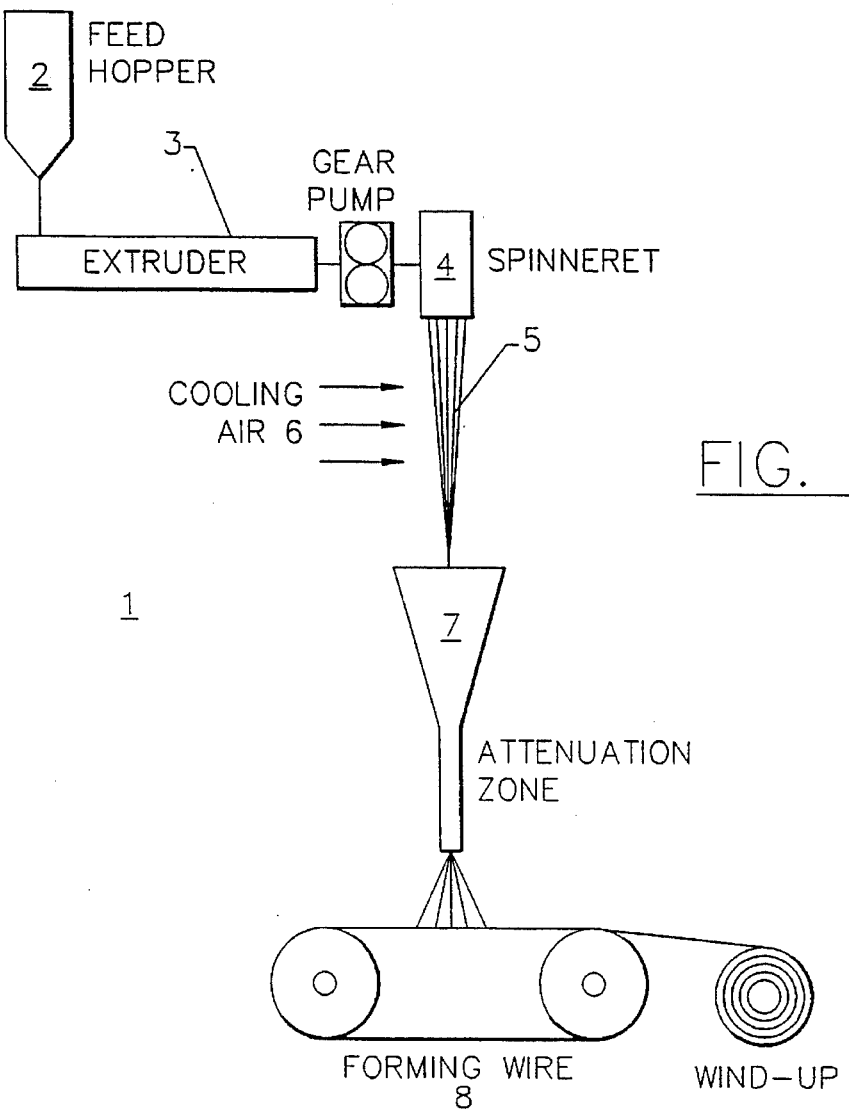
FIG. 1 diagrammatically illustrates a preferred method and apparatus for spinbonding a fabric in accordance with the invention.

FIG. 1 is a diagrammatical view of an apparatus, designated generally as 1, for spunbonding a fabric in accordance with the invention. In a preferred embodiment of the invention, the apparatus is a slot drawing apparatus.

The apparatus 1 comprises a melt spinning section including a feed hopper 2 and an extruder 3 for the polymer. The extruder 3 is provided with a generally linear die head or spinneret 4 for melt spinning streams of substantially continuous filaments 5. The spinneret preferably produces the streams of filaments in substantially equally spaced arrays and the die orifices are preferably from about 0.2 mm to about 0.9 mm in diameter.

In one embodiment of the invention, the substantially continuous filaments 5 are extruded from the spinneret 4 and quenched by a supply of cooling air 6. The filaments are directed to an attenuation zone 7 after they are quenched, and a supply of attenuation air is admitted therein. Although separate quench and attenuation zones are shown in the drawing, it will be apparent to the skilled artisan that the filaments can exit the spinneret 4 directly into an attenuation zone 7 where the filaments can be quenched, either by the supply of attenuation air or by a separate supply of quench air.

The attenuation air may be directed into the attenuation zone 7 by an air supply above the slot, by a vacuum located below a forming wire 8 or by the use of eductors integrally formed in the slot. The air proceeds down the attenuator zone 7, which advantageously narrows in width in the direction away from the spinneret 4, creating a venturi effect and causing filament attenuation. The air and filaments exit the attenuation zone 7 and are collected on a forming wire 8.

Advantageously, the filaments 5 are extruded from the spinneret 4 at a melt temperature of at least about 20° C. above the polymer melt temperature and at a rate sufficient to provide drawn filaments at a rate of about 100 to about 2000 meters per minute. In a preferred embodiment, the filaments 5 are produced at a rate of about 450 to about 1200 meters per minute. As will be recognized by the skilled artisan, spinbonding production rate is determined in large part by the drawing force employed in the draw zone. With drawing forces sufficient to provide a spinbonding rate in excess of 1200–2000 meters per minute, excess filament breakage can occur due to the elastic nature of polymer employed in the invention.

After the filaments are quenched and enter the attenuation zone 7, a draw force is applied with a fluid. Advantageously the filaments are contacted by a moving air stream of relatively low velocity, e.g., a velocity near zero to about 100 meters per minute, which gradually increases to a velocity in the range of about 300 meters per minute to about 3000 meters per minute to thereby provide force on the filaments so that the filaments obtain a maximum linear velocity between about 100 meters per minute and about 2000 meters per minute, which is typically at a point just above the screen. In preferred embodiments, the filaments according to the invention have a denier per filament in the range less than about 50 denier per filament, more preferably from about 1 to about 10 denier per filament, and most preferably from about 2 to about 6 denier per filament.

Preferably the polymers employed in the invention include at least one thermoplastic block copolymer elastomer. Advantageously the elastomer comprises a polymer having a melt flow rate of about 5 to about 500, a swell index of about 1.8 to about 5, and a flexural modulus of about 200 to about 10,000 psi. Preferably the elastomer is a polypropylene-based co- or terpolymer.

In one embodiment of the invention, the polymers employed in the invention are thermoplastic primarily crystalline olefin block copolymers having elastic properties. These polymers are commercially available from Himont, Inc., Wilmington, Del., and are disclosed in European Patent Application Publication 0416379 published Mar. 13, 1991, which is hereby incorporated by reference. The polymer is a heterophasic block copolymer including a crystalline base polymer fraction and an amorphous copolymer fraction having elastic properties which is blocked thereon via a semi-crystalline homo- or copolymer fraction. In a preferred embodiment, the thermoplastic primarily crystalline olefin polymer is comprised of at least about 60 to 85 parts of the crystalline polymer fraction, at least about 1 up to less than 15 parts of the semi-crystalline polymer fraction and at least about 10 to less than 39 parts of the amorphous polymer fraction. Advantageously, the primarily crystalline olefin block copolymer comprises 65 to 75 parts of the crystalline copolymer fraction, from 3 to less than 15 parts of the semi-crystalline polymer fraction, and from 10 to less than 30 parts of the amorphous copolymer fraction.

Preferably the crystalline base polymer block of the heterophasic copolymer is a copolymer of propylene and at least one alpha-olefin having the formula $H_2C{=}CHR$, where R is H or a $C_{2-6}$ straight or branched chain alkyl moiety. Preferably, the amorphous copolymer block with elastic properties of the heterophasic copolymer comprises an alpha-olefin and propylene with or without a diene or a different alpha-olefin termonomer, and the semi-crystalline copolymer block is a low density, essentially linear copolymer consisting substantially of units of the alpha-olefin used to prepare the amorphous block or the alpha-olefin used to prepare the amorphous block present in the greatest amount when two alpha-olefins are used.

Other elastomeric polymers which can be used in the invention include polyurethane elastomers; ethylene-polybutylene copolymers; poly(ethylene-butylene) polystyrene block copolymers, such as those sold under the trade names Kraton G-1657 and Kraton G-652 by Shell Chemical Company, Houston, Tex.; polyadipate esters, such as those sold under the trade names Pellethane 2355-95 AE and Pellethane 2355-55DE by Dow Chemical Company, Midland, Mich.; polyester elastomeric polymers; polyamide elastomeric polymers; polyetherester elastomeric polymers, such as those sold under the trade name Hydrel by DuPont Company of Wilmington, Del.; ABA triblock or radial block copolymers, such as Styrene-Butadiene-Styrene block copolymers sold under the trade name Kraton by Shell Chemical Company; and the like. Also, polymer blends of elastomeric polymers, such as those listed above, with one another and with other thermoplastic polymers, such as polyethylene, polypropylene, polyester, nylon, and the like, may also be used in the invention. Those skilled in the art will recognize that elastomer properties can be adjusted by polymer chemistry and/or by blending elastomers with non-elastomeric polymers to provide elastic properties ranging from fully elastic stretch and recovery properties to relatively low stretch and recovery properties. Preferably a low to medium elastic property elastomer is used in the invention as evidenced by a flexural modulus ranging from about 200 psi to about 10,000 psi, and preferably from about 2000 psi to about 8000 psi.

The thermoplastic substantially continuous filaments according to the invention comprise the thermoplastic elastomer in an amount sufficient to give the fabric at least about a 75% root mean square (RMS) average recoverable elongation based on machine direction (MD) and cross direction (CD) values after 30% elongation and one pull. RMS average recoverable elongations are calculated from the formula: RMS average recoverable elongation=$[\frac{1}{2}(CD^2+MD^2)]^{1/2}$; wherein CD is recoverable elongation in the cross direction and MD is the recoverable elongation in the machine direction. Preferably, the fabrics have at least about a 70% RMS recoverable elongation after two such 30% pulls. More preferably, the filaments of the invention comprise the thermoplastic elastomer in an amount sufficient to give the fabric at least about a 65% RMS recoverable elongation based on machine direction and cross direction values after 50% elongation and one pull, and even more preferably at least about 60% RMS recoverable elongation after two such pulls. Preferably the elastomer constitutes at least about 50%, most preferably at least about 75%, by weight of the filament. Elastic properties of fabrics of the invention are measured using an Instron Testing apparatus, using a 5 inch gauge length and a stretching rate of 5 inches per minute. At the designated stretch or percent elongation value, the sample is held in the stretched state for 30 seconds and then allowed to fully relax at zero force. The percent recovery can then be measured.

Figure 2:
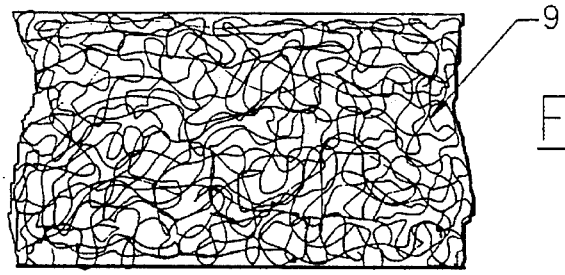
FIG. 2 is a fragmentary plan view of one embodiment of a nonwoven web of the invention.

FIG. 2 is a fragmentary plan view of one embodiment of a web according to the invention. The web designated as 9 is comprised of substantially continuous filaments of the thermoplastic elastomer, prepared as described above. The filaments of the web do not have to be the same in appearance. Further, the web may contain fibers comprised of a material different from that disclosed above. For example, the web 9 may comprise the substantially continuous filaments disclosed above mixed with natural fibers, such as cotton fibers, wool fibers, silk fibers, or the like, or mixed with cellulosic-derived fibers, such as wood fibers, for example wood pulp, rayon fibers, or the like. The substantially continuous filaments of the thermoplastic elastomer may also be mixed with manmade fibers, such as polyester fibers, acrylic fibers, polyamide fibers such as nylon, polyolefin fibers, such as polyethylene, polypropylene, copolymers of the same, or the like, or other thermoplastic polymers, as well as copolymers and blends of these and other thermoplastic fibers. The man-made fibers may be substantially continuous filaments or staple fibers. Advantageously, the webs comprise at least about 50% by weight, and more advantageously at least about 75%, of the substantially continuous filaments of the thermoplastic elastomer.

Figure 3:
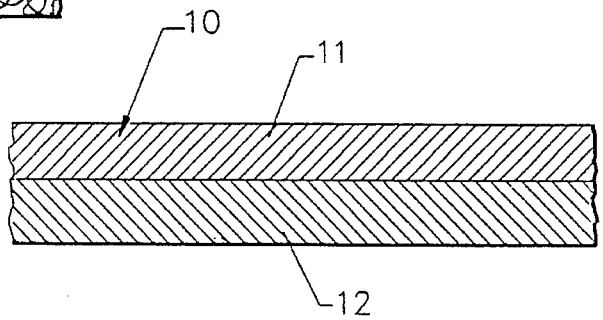
FIG. 3 is a diagrammatical cross-sectional view of a laminate web in accordance with the invention.

FIG. 3 is a diagrammatical cross-sectional view of one embodiment of the invention. The embodiment of FIG. 3, generally indicated at 10, comprises a two ply laminate. Ply 11 comprises a web which may be a meltblown nonwoven web, a spunbonded web, a web of carded staple fibers, or a film, for example, a film of a thermoplastic polymer such as polyethylene, and the like. Ply 12 comprises a nonwoven elastic web according to the invention.

The plies may be bonded and/or laminated in any of the ways known in the art. Lamination and/or bonding may be achieved, for example, by hydroentanglement of the fibers, spot bonding, powder bonding, through air bonding or the like. For example, when ply 11 is a fibrous web, lamination and/or bonding may be achieved by hydroentangling, spot bonding, through air bonding and the like. When ply 11 is a film, lamination and/or bonding may be achieved by spot bonding, direct extrusion of the film on Ply 12, and the like. It is also possible to achieve bonding through the use of an appropriate bonding agent, i.e., an adhesive. The term spot bonding is inclusive of continuous or discontinuous pattern bonding, uniform or random point bonding or a combination thereof, all as are well known in the art.

The bonding may be made after assembly of the laminate so as to join all of the plies or it may be used to join only selected of the fabric plies prior to the final assembly of the laminate. Various plies can be bonded by different bonding agents in different bonding patterns. Overall, laminate bonding can also be used in conjunction with individual layer bonding.

In a preferred embodiment, plies 11 and 12 are laminated by elongating ply 12, holding ply 12 in the thus stretched shape, bonding ply 11 to ply 12, and relaxing the resultant composite structure. Advantageously, the resultant composite structure exhibits a gathered structure.

The laminate 10 of FIG. 3 comprises a two ply structure, but there may be two or more similar or dissimilar plies, such as a spunbond-meltblown-spunbond structure, depending upon the particular properties sought for the laminate. The laminate may be used as an elastic nonwoven component in a disposable absorbent personal care product, such as a topsheet layer, a backsheet layer, or both, in a diaper, an incontinence pad, a sanitary napkin, and the like; as a wipe; as a surgical material, such as a sterile wrap or surgical gown; and the like. For example, a laminate that permits liquid to flow through it rapidly advantageously can be used as a diaper topsheet, while a laminate exhibiting barrier properties can be used as a diaper backsheet.

As is well known in the art, a primary function of absorbent personal care products, such as disposable diapers, adult incontinence pads, sanitary napkins, and the like, is to rapidly absorb and contain body exudates to prevent soiling, wetting, or contamination of clothing or other articles. For example, disposable diapers generally comprise an impermeable backsheet layer, an absorbent core layer, and a topsheet layer to allow rapid flow into the absorbent core. Elasticized leg flaps and barrier leg cuffs can also be added to the absorbent personal care product construction to improve containment and prevent leakage.

Typically, disposable diapers and related articles leak when body exudates escape out through gaps between the article and the wearer's legs or waist. Elastic components, such as those comprising the elastic nonwoven webs or laminates of the invention, can provide absorbent articles with an improved degree of fit to the wearer's legs or body and thus can reduce the propensity for leaking.

The elastic nonwoven web according to the invention can advantageously be used as a coverstock layer in a disposable personal care product, such as a disposable diaper. In one aspect of this embodiment of the invention, the elastic nonwoven web of the invention is used as a topsheet layer in a diaper. The topsheet layer advantageously permits liquid to rapidly flow through it into the absorbent core (referred to in the art as "rapid strike through") but does not facilitate re-transmission of liquid back from the absorbent core to the body side of the topsheet (referred to in the art as "rewet resistance"). To achieve a desirable balance of strike through and rewet resistance, the elastic nonwoven webs of the invention can be treated to impart hydrophilic characteristics thereto. For example, the nonwoven elastic web of the invention or the surface thereof can be treated with a surfactant as are well known in the art, such as Triton X-100 or the like.

The elastic nonwoven web produced as described above is then combined with an absorbent body, for example, a preformed web substantially made of cotton-like woody pulp, located in facing relationship with the inner surface of a substantially liquid impermeable backsheet layer. Wood pulp may be included in the absorbent body, preferably by incorporating the wood fiber from a hammer milled water laid web or from an air laid web which may contain staple textile fibers, such as cotton, reconstituted cellulose fibers, e.g., rayon and cellulose acetate, polyolefins, polyamides, polyesters, and acrylics. The absorbent core may also include an effective amount of an inorganic or organic high-absorbency (e.g., superabsorbency) material as known in the art to enhance the absorptive capability of the absorbent body.

The elastic nonwoven web may be combined with the absorbent body and the substantially liquid impermeable backsheet layer in any of the ways known in the art, such as gluing with lines of hot-melt adhesive, seaming with ultrasonic welding, and the like. Preferably, when the elastic nonwoven web of the invention is used as a topsheet, it is stretched in at least one direction and may be stretched in the machine direction, the cross direction, or in both directions as it is combined with the absorbent core and the backsheet layer to produce a diaper.

In another aspect of this embodiment, an elastic nonwoven web according to the invention is used as a backsheet layer of a diaper. The elastic nonwoven web is advantageously stretched in at least one direction and may be stretched in the machine direction, the cross direction or in both directions. Advantageously, the web is stretched at least about 10%, preferably at least about 30% and most preferably at least about 50%, in the cross direction.

The elastic nonwoven web is given barrier properties by any of the ways known in the art. Preferably, barrier properties are obtained by laminating a polyolefin film, for example a polyethylene or a polypropylene film, to the elastic nonwoven web. For example, the polyolefin film may be laminated with the elastic nonwoven web of the invention by either point or continuous bonding of the web and the film via either smooth or patterned calender rolls. The lamination may also be achieved by the use of an appropriate bonding agent. As noted above the elastic nonwoven web can be held in a stretched shape during the fabric-film lamination.

The elastic nonwoven laminate is then combined with an absorbent body, such as a preformed web of wood pulp, located in a facing relationship with the inner surface of a substantially liquid permeable topsheet layer to produce a diaper. The elastic nonwoven web and the absorbent body may be combined in any of the ways known in the art. Advantageously, the elastic nonwoven laminate is stretched to at least about 10% in the cross direction, layered with the other webs such as the absorbent body and the topsheet layer and the like, and joined thereto by chemical or thermal bonding techniques.

Diapers can also be produced wherein both the topsheet and backsheet layers of a diaper are comprised of an elastic nonwoven web according to the invention. For example, a first elastic nonwoven web according to the invention is stretched and given barrier properties as described above. A second elastic nonwoven web according to the invention is provided and combined with the first web and with an inner absorbent body to form a structure having a substantially liquid impermeable backsheet layer, an absorbent inner layer and a substantially liquid permeable topsheet layer.

The elastic nonwoven webs and laminates of the invention are particularly useful for use in the leg flaps and/or waist band areas of absorbent products to produce a soft, cloth-like elastic structure. The elastic nonwoven webs of this invention can thus be used to replace strands of elastic filaments, heat shrinkable films, and the like, to produce a product having a leak resistant fit with improved softness and protection from red marks on the wearer's legs or waist.

The elastic nonwoven webs of the invention can also be used to produce barrier leg cuffs known in the art, such as those described in U.S. Pat. No. 4,695,278, incorporated herein by reference. Use of elastic nonwoven webs or laminates of the invention as barrier leg cuff fabric thus can reduce or eliminate the need for strands of elastic filaments to provide leak-resistant fit with improved softness.

In accordance with another preferred aspect of the invention, improved SMS (spunbond/meltblown/spunbond) medical barrier fabrics are provided in which at least one of the spunbond layers is an elastic spunbond fabric. Conformability of the SMS laminate can be substantially improved according to this aspect of the invention. Among the known uses of SMS fabrics, the use of these fabrics as sterile wraps is of substantial significance. Because an elastic SMS fabric is capable of conforming to a wrapped article, the elastic SMS fabric of the invention provides significant advantages and benefits. Moreover, when the elastic fabric is stretched as it is wrapped around an article, the fabric can exhibit "self opening" capabilities when the wrap is removed from the article. This, in turn, can eliminate or minimize the need or possibility of incidental contact with the sterile article during removal of the sterile wrap.

The elastic SMS barrier fabrics of the invention are manufactured by lamination of the spunbond, meltblown or spunbond layers, preferably by thermal spot bonding or other discontinuous bonding as is well known in the art and described herein previously. Preferably the elastic spunbond layer (or layers) is stretched in an amount of 5–40%, preferably 10–25% in either the MD or CD or in both directions prior to, and during, lamination to the meltblown layer. Following bonding, the laminate is relaxed. Thereafter the laminate can be stretched , e.g., during use, without substantial damage to the meltblown layer and without a substantial decrease in barrier properties.

The elastic nonwoven webs according to the invention may also be used as a component in other disposable products, such as incontinence pads, sanitary napkins, protective clothing, various medical fabrics, bandages, and the like. For example, as with the construction of diapers, the elastic nonwoven webs of the invention may be used as a topsheet layer, backsheet layer, or both, in disposable personal care products. Further, the elastic nonwoven webs of the invention may be used in these products in combination with other webs, such as a liquid impermeable layer and an absorbent body.

EXAMPLE 1

In this example four polymers were processed into spunbond fabrics. Sample 1A is a polypropylene homopolymer control, manufactured by Soltex and having controlled rheology (CR) grade 3907, i.e., a 35 melt flow rate (MFR). Samples 1B and 1C are primarily crystalline olefin heterophasic copolymers of polypropylene as described previously, produced by Himont and represented as CATALLOY(r) polymers. Polymers 1B and 1C have intermediate levels of elasticity and are included for comparison. Sample 1D is a heterophasic copolymer of the same type but having properties that are representative of those believed most advantageous of the present invention.

The four polymers were analyzed using Differential Scanning Calorimetry (DSC), Fourier Transform Infrared Spectroscopy (FT-IR), C13 Nuclear Magnetic Resonance (NMR), Gel Permeation Chromatography (GPC), Instron Capillary Rheometry, a melt indexer and a cone die swell apparatus.

The DSC experiments were carried out using a DuPont Instruments Cell Base Module and DSC cell controlled by a Model 2100 Thermal Analyst System. The cell was purged with Nitrogen gas at a nominal flow rate of 40 ml/minute. The samples were weighed into the DSC sample pans using a Mettler ME-30 microbalance and heated from room temperature to 200° C. at a heating rate of 10° C./minute. The employed reference was an empty sample pan container and lid. All data manipulation was performed using the standard general TA software.

The GPC experiments were conducted using a Waters 150° C. ALC/GPC and Waters 840 Chromatography Control and data station. The columns used were 2 by 30 cm PL-Gel mixed bed columns with a refractive index detector (128/5). 1,2,4-trichlorobenzene was used as the mobile phase at a flow rate of 1.0 ml/minute. The column temperature was maintained at 135° C.

The melt flow rate (MFR) of polymers is determined by the quantity of polymer that passes through an orifice at 190° C. under a 2.16 Kg load. The melt flow rate has an inverse relationship to the viscosity of the polymer. That is, the lower the viscosity, the higher the MFR.

A comparison of the polymer characteristics appear in Table 1. Polymers within this class of olefinic elastomers having a flexural modulus above about 180,000 psi were found to be unsuitable for the production of moderately elastic nonwovens.

The spinability of each of the polymers was first evaluated on a Lurgi spinning system. The results appear in Table 1. Spinability was rated based on the frequency of polymer related filament breaks at a constant throughput (1 gram/minute/hole) and a draw force that produced filaments of about 2.5 denier. The most spinnable was given a rating of '5' and defined as having no breaks at greater than 3000 meters per minute (mpm). Polymers which could not be drawn at low Lurgi speeds (ie. <500 mpm) were given a rating of '0'. Slot draw spinability was determined employing a vacuum based slot draw system operated at a draw force sufficient to produce spunbonded filaments at a rate of about 500–700 meters per minute. Spinability was based on the frequency of filament breaks at constant throughput and a draw force sufficient to produce 2.5 denier filaments.

TABLE 1

POLYMER CHARACTERIZATION

| SAMPLE NO. DESCRIPTION | 1D RUBBERY | 1B INTERMEDIATE | 1C INTERMEDIATE | 1A PP |
|---|---|---|---|---|
| Flexural Modulus (a) | 5054 psi (35 Mpa) | — | — | 188,765 psi (1300 Mpa) |
| Spinability: | | | | |
| Lurgi | 0 | 2 | 2 | 5 |
| Slot draw, 600 m/min | 3.5 | 4 | 4 | 5 |
| Fabric Properties | Stretchy | Stiff | Stiff | Stiff |
| Ethylene (mole %) | 27.4 | 20.2 | 18.7 | 0 |
| Propylene (mole %) | 72.6 | 79.8 | 81.3 | 100 |
| DSC: | | | | |
| Onset, °C. | 130.5 | 147.8 | 150.7 | 158.2 |
| Tmp, °C. | 144.4 | 161.6 | 162.5 | 165.2 |
| H, J/g | 21.4 | 31.7 | 46.9 | 71.9 |
| GPC: | | | | |
| Mn | 53,650 | 49,180 | 45,680 | 42,330 |
| Mw | 195,900 | 178,500 | 155,300 | 159,400 |
| Mz | 492,700 | 470,200 | 349,800 | 370,800 |
| D | 3.651 | 3.630 | 3.402 | 3.767 |
| True Viscosity @ 210 C (Pa.sec) (b) Apparent Shear Rate: | | | | |
| 16.4 1/sec | 391 | 296 | 299 | 335 |

TABLE 1-continued

POLYMER CHARACTERIZATION

| SAMPLE NO. DESCRIPTION | 1D RUBBERY | 1B INTERMEDIATE | 1C INTERMEDIATE | 1A PP |
|---|---|---|---|---|
| 164 1/sec | 231 | 201 | 178 | 177 |
| 1640 1/sec | 57.5 | 50 | 47 | 41 |
| Melt Index (c) | 12.9 | 13.5 | 16.1 | 16.7 |

a) ASTM D790-86 [average of two runs; Tangent modulus of elasticity $E = (0.21\ L^3\ m)/(bd^3)$, where L = support span (3 inches); b = sample width; d = sample thickness; and m = slope of deflection curve]
b) Instron Capillary Rheometer [(0.0762 cm diameter capillary and 3.048 cm in length; barrel diameter equals 0.9525 cm):190° C. and 210° C.]. Calculations based from Principles of Polymer Processing, Z. Tadmor & C. G. Gogos, Wiley Interscience, March 1978.
c) ASTM D1238-89, Procedure A, Condition E [190° C./2.16 kg/77 die orifice]

EXAMPLE 2

In this example, six nonwoven fabric samples were prepared, elongated and then analyzed with respect to the recoverable elongation of each in both the machine and cross direction of the fabric. Fabric sample numbers 2A, 2B, 2C, and 2D were polyethylene and three polypropylene controls, respectively. Fabric sample numbers 2E and 2F were fabrics prepared according to the invention using primarily crystalline olefin heterophasic copolymers of polypropylene as described previously and available from Himont. The elastic properties of the fabrics were measured using an Instron Testing apparatus, using a 5 inch gauge length and a stretching rate of 5 inches per minute. At the designated stretch or percent elongation value, i.e., here at 30% and 50% elongation, the sample is held in the stretched state for 30 seconds and then allowed to fully relax at zero force. The percent recovery (based on original fabric length) can then be measured. The elongation recovery values were based upon recovery of the fabric (i.e., the ability of the fabric to return to its original size upon release) after both a first pull and a second pull. Elongation recovery values were measured in both the machine and cross direction to give a root mean square value, and the results are set forth in Table 2 below.

TABLE 2

ROOT MEAN SQUARE RECOVERIES

| SAMPLE NO. | DESCRIPTION | PERCENT RECOVERY (%) @ 30% ELONGATION CD PULL1 | CD PULL2 | MD PULL1 | MD PULL2 | RMS (1) @ 30% ELONGATION PULL1 | PULL2 |
|---|---|---|---|---|---|---|---|
| 2A | LURGI, Linear Low Density Polyethylene (LLDPE) | | | | | FAILED | FAILED |
| 2B | SLOT DRAW, 600M/MIN 12% BOND AREA, Polypropylene | 65.3 | 54 | 63.1 | 55.4 | 64.2 | 54.7 |
| 2C | SLOT DRAW, 600M/MIN 24% BOND AREA, Polypropylene | 72.7 | 63.9 | 72 | 64.6 | 72.4 | 64.3 |
| 2D | LURGI, Polypropylene | | | | | FAILED | FAILED |

TABLE 2-continued

| | | | | | | | |
|---|---|---|---|---|---|---|---|
| 2E | SLOT DRAW, 600M/MIN | 96.8 | 97 | 84.3 | 80.7 | 90.8 | 89.2 |
| 2F | SLOT DRAW, Procedure similar to Example 3 | 80.2 | 74.2 | 82.6 | 78 | 81.4 | 76.1 |

| SAMPLE | | PERCENT RECOVERY @ 50% ELONGATION | | | | RMS (1) @ 50% ELONGATION | |
|---|---|---|---|---|---|---|---|
| | | CD | | MD | | | |
| NO. | DESCRIPTION | PULL1 | PULL2 | PULL1 | PULL2 | PULL1 | PULL2 |
| 2A | LURGI, Linear Low Density Polyethylene (LLDPE) | | | | | FAILED | FAILED |
| 2B | SLOT DRAW, 600M/MIN 12% BOND AREA, Polypropylene | 55.1 | 46.5 | 54.4 | 45.5 | 54.8 | 46.0 |
| 2C | SLOT DRAW, 600M/MIN 24% BOND AREA, Polypropylene | 62.8 | 53.8 | 59.1 | 48.7 | 61.0 | 51.3 |
| 2D | LURGI, Polypropylene | | | | | FAILED | FAILED |
| 2E | SLOT DRAW, 600M/MIN | 94.8 | 93.9 | 77.7 | 73.9 | 86.7 | 84.5 |
| 2F | SLOT DRAW, Procedure similar to Example 3 | 74 | 68.3 | 76.3 | 71.4 | 75.2 | 69.9 |

(1) Root Mean Square $= \sqrt{\frac{MD^2 + CD^2}{2}}$

EXAMPLE 3

A sample of the nonwoven fabric according to the invention, similar to Sample 2F, is produced by extrusion of the polymer taught in European Patent Application 416,379 on a slot draw melt spinning line available from Reifenhauser GmbH. The apparatus is one meter wide and has a single beam, 2-sided quench zone. Further, it has dual extruder capability, with side-arm and dry-blend volumetric additive systems. There is an automatic filter changer between the extruder and the spin pump. This spin pack can be chosen as a screen, Dynalloy, or others known in the art. The spinneret is a one or two melt pump fed spinneret having 6500 holes. The capillary geometry is as follows: 0.357 millimeter diameter, 6:1l/d. The spinneret temperature is controlled by the melt temperature and polymer throughput, i.e., it is not independently heated.

The first 10 inches of the quench zone is cooled air of about 3° C. The remaining 6 feet of quench is accelerated air at about room temperature, or about 25° C. The slot draw has an adjustable width, and is used at a 1 inch width. The polymer is extruded as substantially continuous filaments having about 2 dpf, thus equalling an output of about 75 kilograms per hour per meter or 0.192 grams per minute per hole.

EXAMPLE 4

A sample of a nonwoven web was prepared using polymer 1D (Example 1) and a vacuum based slot draw system operated at a draw force sufficient to product spunbonded filaments at a rate of about 600M/MIN. The web measured 10 inches in the cross direction and 2 inches in the machine direction, and was stretched by 30% of its length in the cross direction. The resulting web was 13 inches in the cross direction. The sample was attached over the front nonelastic waistband of a generic diaper, giving a diaper with improved elastic recovery.

EXAMPLE 5

A sample of a nonwoven web prepared substantially as described in Example 4 measuring 8⅝ inches in the cross direction and 2 inches in the machine direction was stretched by 50% in the cross direction. The resulting web was 13 inches in length in the cross direction. The sample was attached over the front nonelastic waistband of the generic diaper. The resulting diaper exhibited improved elastic recovery and provided improved waistband snugness.

EXAMPLE 6

A sample of a nonwoven web was prepared substantially as described in Example 4 measuring 5 13/16 inches in the cross direction and 2½ inches machine direction. The web was stretched by 50% in the cross direction to give a cross direction length of 8¾ inches. A generic brand diaper was provided, and its leg elastic removed. The sample of the nonwoven web was attached to the leg gatherings to replace the removed leg elastic. The resulting diaper exhibited moderate elongation and recovery in the leg cuff area.

EXAMPLE 7

A sample of a nonwoven web was prepared substantially as described in Example 4 using polymer 1D and was tested to determine its characteristics. A total of ten samples were tested to determine an average basis weight (grams per square yard) and caliper (mils). A total of three samples each were tested to determine tensile strength (grams per inch), peak elongation and tear strength. Additionally, two samples each were tested to determine elasticity at 10, 30 and 50% stretch held at 100° F. for 30 minutes. The reported values are "% set" or the non-recoverable portion of elongation following relaxation. The results of the test are set out in the table below.

TABLE 3

| PROPERTY | RESULTS | | N* |
|---|---|---|---|
| BASIS WEIGHT ($g/yd^2$) | 31.3 (25.5 to 36.4) | | 10 |
| CALIPER (mils) | 11.0 (8.2 to 14.0) | | 10 |
| TENSILES (g/in) | | | |
| CD*** | 654 (646 to 659) | | 3 |
| MD*** | 1150 (917 to 1445) | | 3 |
| PEAK ELONGATION (%) | | | |
| CD*** | 174 (147 to 188) | | 3 |
| MD*** | 156 (133 to 173) | | 3 |
| TEA** ($in.g./in^2$) | | | |
| CD*** | 819 (715 to 960) | | 3 |
| MD*** | 1302 (881 to 1649) | | 3 |
| ELASTICITY 30 | CD | MD | |
| min @ 100° F. | — | — | |
| 10% Stretch | −7.3 (−6.3 to −8.3) | −4.2 (−4.2 to −4.2) | 2 |
| 30% Stretch | −17.8 (−16.7 to −18.8) | −15.7 (−14.6 to −16.7) | 2 |
| 50% Stretch | −30.2 (−27.1 to −33.1) | −25.0 (−25.0 to −25.0) | 2 |

*N = Number of Samples
**Tensile Energy Absorption
***Measured using 5 in. gauge length and 5 in./min. pull rate The invention has been described in considerable detail with reference to its preferred embodiments. It will be apparent that numerous variations and modifications can be made without departing from the spirit and scope of the invention as described in the foregoing detailed specification and as defined in the following claims.

That which is claimed is:

1. A spunbonded fabric comprising a web of bonded elastomeric thermoplastic substantially continuous filaments, said spunbonded fabric having a root mean square average recoverable elongation of at least about 75% based on machine direction and cross direction recoverable elongation values of the fabric after 30% elongation of the fabric and one pull, said fabric having been prepared by a spunbonding process conducted at a rate of less than about 1,200 meters per minute.

2. A spunbonded fabric according to claim 1, said spunbonded fabric further having a root mean square average recoverable elongation of at least about 70% based on machine direction and cross direction recoverable elongation values of the fabric after 30% elongation of the fabric and two pulls.

3. A spunbonded fabric according to claim 1, said spunbonded fabric having a root mean square average recoverable elongation of at least about 65% based on machine direction and cross direction recoverable elongation values of the fabric after 50% elongation of the fabric and one pull.

4. A spunbonded fabric according to claim 1, said spunbonded fabric further having a root mean square average recoverable elongation of at least about 60% based on machine direction and cross direction recoverable elongation values of the fabric after 50% elongation of the fabric and two pulls.

5. A spunbonded fabric according to claim 1 wherein said thermoplastic elastomeric filaments comprise an elastomer selected from the group consisting of polyurethanes, ABA block copolymers, ethylene-polybutylene copolymers, poly-(ethylenebutylene) polystyrene block copolymers, polyadipate esters, polyester elastomeric polymers, polyamide elastomeric polymers, polyetherester elastomeric polymers, primarily crystalline heterophasic olefin copolymers, and polymer blends thereof.

6. A spunbonded fabric according to claim 5 wherein said polymer blends comprise a polymer selected from the group consisting of polyethylene, polypropylene, polyester, and nylon.

7. A spunbonded fabric according to claim 1 wherein said thermoplastic elastomer is an olefin-based elastomer having a melt flow rate of about 5 to about 500.

8. A spunbonded fabric according to claim 7 wherein said thermoplastic olefin-based elastomer has a swell index of about 1.8 to about 5.

9. A spunbonded fabric according to claim 7 wherein said thermoplastic olefin-based elastomer has a flexural modulus of about 200 to about 10,000 psi.

10. A spunbonded fabric according to claim 7 wherein said thermoplastic olefin-based elastomer has a flexural modulus of about 2000 to about 8000 psi.

11. A spunbonded fabric according to claim 7 wherein said thermoplastic olefin based elastomer is a primarily crystalline heterophasic olefin copolymer comprising a crystalline base polymer block and an elastomeric amorphous copolymer block attached to the crystalline base polymer via a semi-crystalline polymer block fraction.

12. A spunbonded fabric comprising a web of bonded elastomeric thermoplastic substantially continuous filaments, said spunbonded fabric having a root mean square average recoverable elongation of at least about 75% based on machine direction and cross direction recoverable elongation values of the fabric after 30% elongation of the fabric and one pull, wherein said thermoplastic elastomer is selected from the group consisting of polyurethanes, ABA block copolymer, ethylene-polybutylene copolymers, poly-(ethylene-butylene) polystyrene block copolymers, polyadipate esters, polyester elastomeric polymers, polyamide elastomeric polymers, polyetherester elastomeric polymers, primarily crystalline heterophasic olefin copolymers, and polymer blends thereof, said fabric having been prepared by a spunbonding process conducted at a rate less than about 1,200 meters per minute.

13. A spunbonded fabric comprising a web of bonded theremoplastic substantially continuous filaments, said thermoplastic filaments comprising a thermoplastic olefin-based elastomer comprising a polymer having a melt flow rate of about 5 to about 500, a swell index of about 1.8 to about 5, and a flexural modulus of about 200 to about 10,000 psi, said thermoplastic olefin-based elastomer being present in said thermoplastic filaments in an amount sufficient that said spunbonded fabric has a root mean square average recoverable elongation of at least about 75% based on average machine direction and cross direction recoverable elongation values of the fabric after 30% elongation of the fabric and one pull.

14. A spunbonded fabric comprising a web of bonded thermoplastic substantially continuous filaments, said thermoplastic filaments comprising a thermoplastic primarily crystalline olefin heterophasic block copolymer including a crystalline base polymer block and an elastomeric amorphous copolymer block attached to the crystalline base polymer via a semi-crystalline polymer block fraction, said thermoplastic primarily crystalline olefin heterophasic block copolymer being present in said elastomeric thermoplastic filaments in an amount sufficient that said spunbonded fabric has a root mean square average recoverable elongation of at least about 75% based on machine direction and cross direction recoverable elongation values of the fabric after 30% elongation of the fabric and one pull.

15. A spunbonded fabric according to claim 14, said spunbonded fabric further having a root mean square recoverable elongation of at least about 70% based on average machine direction and cross direction recoverable elongation values of the fabric after 30% elongation of the fabric and two pulls.

16. A spunbonded fabric according to claim 14, said spunbonded fabric further having a root mean square average recoverable elongation of at least about 60% based on machine direction and cross direction recoverable elongation values of the fabric after 50% elongation of the fabric and two pulls.

17. A spunbonded fabric according to claim 14 wherein said thermoplastic filaments are prepared by a spunbonding process conducted at a rate of less than about 2000 meters per minute.

18. A spunbonded fabric according to claim 14 wherein said copolymer has a melt flow rate of about 5 to about 500.

19. A spunbonded fabric according to claim 14 wherein said copolymer has a swell index of about 1.8 to about 5.

20. A spunbonded fabric according to claim 14 wherein said copolymer has a flexural modulus of about 200 to about 10,000 psi.

21. A spunbonded fabric according to claim 14 wherein said copolymer has a flexural modulus of about 2000 to about 8000 psi.

22. A spunbonded fabric according to claim 14 wherein the crystalline base polymer block is present in said heterophasic copolymer in an amount of between about 60 and about 85 parts by weight.

23. A spunbonded fabric according to claim 14 wherein the crystalline base polymer block is present in said heterophasic copolymer in an amount of between about 65 to about 75 parts by weight.

24. A spunbonded fabric according to claim 14 wherein the crystalline base polymer block of the heterophasic copolymer is a copolymer of propylene and at least one alpha-olefin having the formula $H_2C{=}CHR$, where R is H or a $C_{2-6}$ straight or branched chain alkyl moiety.

25. A spunbonded fabric according to claim 14 wherein the amorphous copolymer block with elastic properties of the heterophasic copolymer is present in said heterophasic copolymer in an amount of about 10 to about 40 parts by weight.

26. A spunbonded fabric according to claim 14 wherein the amorphous copolymer block with elastic properties of the heterophasic copolymer is present in said heterophasic copolymer in an amount of about 10 to less than about 30 parts by weight.

27. A spunbonded fabric according to claim 14 wherein the amorphous copolymer block with elastic properties of the heterophasic copolymer comprises an alpha-olefin and propylene with or without a diene or a different alpha-olefin termonomer.

28. A spunbonded fabric according to claim 14 wherein the semi-crystalline copolymer block is present in said heterophasic copolymer in an amount of about 1 to less than about 15 parts by weight.

29. A spunbonded fabric according to claim 14 wherein the semi-crystalline copolymer block is a low density, essentially linear copolymer consisting substantially of units of the alpha-olefin used to prepare the amorphous block or the alpha-olefin used to prepare the amorphous block present in the greatest amount when two alpha-olefins are used.

30. A spunbonded fabric comprising a web of bonded thermoplastic substantially continuous filaments, said bonded thermoplastic filaments comprising a thermoplastic primarily crystalline olefin heterophasic elastic block copolymer including a crystalline base polymer block present in an amount of from about 60 to 85 parts by weight and an amorphous copolymer block with elastic properties as a second phase in an amount of from about 10 to about 40 parts by weight blocked to the crystalline base polymer block via a semi-crystalline copolymer block in an amount of from about 1 to about 15 parts by weight, said thermoplastic primarily crystalline olefin heterophasic block copolymer being present in said thermoplastic filaments in an amount sufficient that said spunbonded fabric has a root mean square average recoverable elongation of at least about 75% based on machine direction and cross direction recoverable of the fabric after 30% elongation of the fabric and one pull.

31. A disposable absorbent personal care product comprising a plurality of layers, at least one of said layers comprising a spunbonded fabric comprising a web of bonded thermoplastic substantially continuous elastomeric filaments, said spunbonded fabric having a root means square average recoverable elongation of at least about 75% based on machine direction and cross direction recoverable elongation values of the fabric after 30% elongation of the fabric after one pull, wherein said bonded thermoplastic elastomeric filaments are prepared by a spunbonding process conducted at a rate of less than 1,200 meters per minutes.

32. A disposable absorbent personal care product according to claim 31 wherein said thermoplastic elastomeric filaments comprise an elastomer selected from the group consisting of polyurethanes, ABA block copolymers, ethylene-polybutylene copolymers, poly(ethylene-butylene) polystyrene block copolymers, polyadipate esters, polyester elastomeric polymers, polyamide elastomeric polymers, polyetherester elastomeric polymers, primarily crystalline heterophasic olefin copolymers, and polymer blends thereof.

33. A disposable absorbent personal care product according to claim 32 wherein said polymer blends comprise a polymer selected from the group consisting of polyethylene, polypropylene, polyester, and nylon.

34. A disposable absorbent personal care product according to claim 31 wherein said disposable absorbent personal care is a diaper or incontinence pad.

35. A disposable absorbent personal care product according to claim 31 wherein said disposable absorbent personal care is a sanitary napkin.

36. A disposable absorbent personal care product comprising a plurality of layers, at least one of said layers comprising a spunbonded fabric comprising a web of bonded thermoplastic substantially continuous filaments, said bonded thermoplastic filaments comprising a thermoplastic primarily crystalline olefin heterophasic block copolymer including a crystalline base polymer block and an amorphous copolymer block with elastic properties as a second phase blocked to the crystalline base polymer block via a semi-crystalline copolymer block, said thermoplastic primarily crystalline olefin heterophasic block copolymer being present in said bonded thermoplastic filaments in an amount sufficient that said spunbonded fabric has a root mean square average recoverable elongation of at least about 75% based on machine direction and cross direction recoverable elongation values of the fabric after 30% elongation of the fabric and one pull.

37. A medical barrier composite fabric comprising at least one meltblown fabric layer bonded to and sandwiched between opposing spunbonded fabric layers, wherein at least one of said opposing spunbonded fabric layers is an elastic spunbonded fabric comprising a web of bonded thermoplastic substantially continuous elastomeric filaments and having a root mean square average recoverable elongation of at least 75% based on machine direction and cross direction recoverable elongation values after 30% elongation of the fabric and one pull, wherein said bonded thermoplastic elastomeric filaments are prepared by a spunbonding process conducted at a rate of less than 1,200 meters per minute.

38. the medical barrier composite fabric according to claim 37 wherein said elastic spunbonded layer is maintained in a stretched condition during bonding to said meltblown layer.

39. The medical barrier composite fabric according to claim 38 comprising a plurality of thermal spot bonds for bonding of said opposing spunbonded layers and said meltblown layer to each other.

40. A medical barrier composite fabric according to claim 37 wherein said thermoplastic elastomeric filaments comprise an elastomer selected from the group consisting of polyurethanes, ABA block copolymers, ethylene-polybutylene copolymers, poly(ethylene-butylene) polystyrene block copolymers, polyadipate esters, polyester elastomeric polymers, polyamide elastomeric polymers, polyetherester elastomeric polymers, primarily crystalline heterophasic olefin copolymers, and polymer blends thereof.

41. A medical barrier composite fabric according to claim 40 wherein said polymer blends comprise a polymer selected from the group consisting of polyethylene, polypropylene, polyester, and nylon.

42. A method for producing an elastic nonwoven fabric, the method comprising:

extruding molten thermoplastic elastomer through a spinneret to form a plurality of filaments, quenching said plurality of filaments sufficiently to produce substantially non-tacky filaments;

drawing said non-tacky filaments by contacting the non-tacky filaments with a high velocity fluid; and collecting said as a web of bonded filaments at a rate of at least about 100 meters per minute up to about 2000 meters per minute.

43. A method according to claim 32 wherein said molten elastomer is selected from the group consisting of polyurethanes, ABA block copolymers, ethylene-polybutylene copolymers, poly(ethylene-butylene) polystyrene block copolymers, polyadipate esters, polyester elastomeric polymers, polyamide elastomeric polymers, polyetherester elastomeric polymers, primarily crystalline heterophasic olefin copolymers, and polymer blends thereof.

44. A method according to claim 43 wherein said polymer blends comprise a polymer selected from the group consisting of polyethylene, polypropylene, polyester, and nylon.

45. The process of claim 42 wherein said filaments are collected at a rate of less than about 1,500 meters per minute.

46. A method for producing an elastic nonwoven fabric, the method comprising:

extruding molten thermoplastic polymer through a spinneret to form a plurality of filaments, said molten thermoplastic polymer comprising a thermoplastic primarily crystalline olefin heterophasic block copolymer including a crystalline base polymer block and an amorphous copolymer block with elastic properties as a second phase blocked to the crystalline base polymer block via a semi-crystalline copolymer block in an amount sufficient to provide a fabric having a root mean square average recoverable elongation of at least about 75% based on machine direction and cross direction recoverable elongation values of the fabric after 30% elongation of the fabric and one pull;

quenching said plurality of filaments sufficiently to produce substantially non-tacky filaments;

drawing said non-tacky filaments by contacting the non-tacky filaments with a high velocity fluid; and collecting said filaments as a web of bonded filaments.

47. A method according to claim 46 wherein the step of drawing the filaments comprises the step of contacting the filaments with a fluid at a velocity of about 0 to 100 meters per minute and gradually increasing the velocity of said fluid to at least about 1000 meters per minute.

48. A method of making a disposable absorbent personal care product, the method comprising:

providing a spunbonded fabric comprising a web of bonded thermoplastic substantially continuous elastomeric filaments, said bonded thermoplastic elastomeric filaments having been prepared by a spunbonding process conducted at a rate less than about 2000 meters per minute, said spunbonded fabric having a root mean square average recoverable elongation of at least about 75% based on machine direction and cross direction recoverable elongation values of the fabric after 30% elongation of the fabric and one pull; and combining said web of bonded thermoplastic substantially continuous filaments with an absorbent laminate comprising an absorbent body layer located in facing relationship with the inner surface of a substantially liquid impermeable backsheet layer.

49. A method of making a disposable absorbent personal care product, the method comprising:

providing a web of bonded thermoplastic substantially continuous elastomeric filaments, said bonded thermoplastic elastomeric filaments having been prepared by a spunbonding process conducted at a rate less than about 2000 meters per minute, said spunbonded fabric having a root mean square average recoverable elongation of at least about 75% based on machine direction and cross direction recoverable elongation values of the fabric after 30% elongation of the fabric and one pull; and stretching said web of bonded thermoplastic substantially continuous filaments by at least about 10% of its original size;

providing barrier properties to said web of bonded thermoplastic substantially continuous filaments; and combining said web of bonded thermoplastic substantially continuous filaments with an absorbent article comprising an absorbent body located in facing relationship with the inner surface of a substantially liquid permeable topsheet layer.

50. A method according to claim 49 wherein the step of providing barrier properties to said web of bonded thermoplastic substantially continuous filaments comprises the step of laminating a polyolefin film to the web of bonded thermoplastic substantially continuous filaments.

51. A method of making a disposable absorbent personal care product, the method comprising:

providing a web of bonded thermoplastic substantially continuous elastomeric filaments, said bonded thermoplastic elastomeric filaments having been prepared by a spunbonding process conducted at a rate less than about 2000 meters per minute, said spunbonded fabric having a root mean square average recoverable elongation of at least about 75% based on machine direction and cross direction recoverable elongation values of the fabric after 30% elongation of the fabric and one pull; and stretching said first web of bonded thermoplastic substantially continuous filaments by at least about 10%;

providing barrier properties to said first web of bonded thermoplastic substantially continuous filaments while said web is in the stretched condition;

providing a second spunbonded fabric comprising a web of bonded thermoplastic elastomeric substantially continuous filaments, said bonded thermoplastic elastomeric filaments having been prepared by a spunbonding process conducted at a rate less than about 2000 meters per minute, said spunbonded fabric having a root mean square average recoverable elongation of at least about 75% based on machine direction and cross direction recoverable elongation values of the fabric after 30% elongation of the fabric and one pull; and combining said first web and said second web with an absorbent body to form a structure having a substantially liquid impermeable backsheet layer, an absorbent inner layer and a substantially liquid permeable topsheet layer.

52. A method of making a disposable absorbent personal care product, the method comprising:

providing a spunbonded fabric comprising a web of bonded thermoplastic substantially continuous filaments, said bonded thermoplastic filaments comprising a thermoplastic primarily crystalline olefin heterophasic block copolymer including a crystalline base polymer block and an amorphous copolymer block with elastic properties as a second phase blocked to the crystalline base polymer block via a semi-crystalline copolymer block, said heterophasic copolymer being present in said elastic thermoplastic filaments in an amount sufficient that said spunbonded fabric has a root mean square average recoverable elongation of at least about 75% based on both machine direction and cross direction recoverable elongation values of the fabric after 30% elongation of the fabric and one pull; and combining said web of bonded thermoplastic substantially continuous filaments with an absorbent laminate comprising an absorbent body layer located in facing relationship with the inner surface of a substantially liquid impermeable backsheet layer.

53. A method of making a disposable absorbent personal care product, the method comprising:

providing a spunbonded fabric comprising a web of bonded thermoplastic substantially continuous filaments, said thermoplastic filaments comprising a thermoplastic primarily crystalline olefin heterophasic block copolymer including a crystalline base polymer block and an amorphous copolymer block with elastic properties as a second phase blocked to the crystalline base polymer block via a semi-crystalline copolymer block, said heterophasic copolymer being present in said entangled thermoplastic filaments in an amount sufficient that said spunbonded fabric has a root mean square average recoverable elongation of at least about 75% based on machine direction and cross direction recoverable elongation values of the fabric after 30% elongation of the fabric and one pull;

stretching said web of bonded thermoplastic substantially continuous filaments by at least about 10% of its original size;

providing barrier properties to said web of bonded thermoplastic substantially continuous filaments; and combining said web of bonded thermoplastic substantially continuous filaments with an absorbent article comprising an absorbent body located in facing relationship with the inner surface of a substantially liquid permeable topsheet layer.

54. A method according to claim 53 wherein the step of providing barrier properties to said web of bonded thermoplastic substantially continuous filaments comprises the step of laminating a polyolefin film to the web of bonded thermoplastic substantially continuous filaments.

55. A method of making a disposable absorbent personal care product, the method comprising:

providing a first spunbonded fabric comprising a web of bonded thermoplastic substantially continuous filaments, said bonded thermoplastic filaments comprising a thermoplastic primarily crystalline olefin heterophasic block copolymer including a crystalline base polymer block and an amorphous copolymer block with elastic properties as a second phase blocked to the crystalline base polymer block via a semi-crystalline copolymer block, said heterophasic copolymer being present in said bonded thermoplastic filaments in an amount sufficient that said spunbonded fabric has a root mean square average recoverable elongation of at least about 75% based on machine direction and cross direction recoverable elongation values of the fabric after 30% elongation of the fabric and one pull;

stretching said first web of bonded thermoplastic substantially continuous filaments by at least about 10%;

providing barrier properties to said first web of bonded thermoplastic substantially continuous filaments while said web is in the stretched condition;

providing a second spunbonded fabric comprising a web of bonded thermoplastic substantially continuous filaments, said bonded thermoplastic filaments comprising thermoplastic primarily crystalline olefin heterophasic block copolymer including a crystalline base polymer block and an amorphous copolymer block with elastic properties as a second phase blocked to the crystalline base polymer block via a semi-crystalline copolymer block, said heterophasic copolymer being present in said bonded thermoplastic filaments in an amount sufficient that said spunbonded fabric has a root mean square average recoverable elongation of at least about 75% based on machine direction and cross direction recoverable elongation values of the fabric after 30% elongation of the fabric and one pull; and combining said first web and said second web with an absorbent body to form a structure having a substantially liquid impermeable backsheet layer, an absorbent inner layer and a substantially liquid permeable topsheet layer.

* * * * *

UNITED STATES PATENT AND TRADEMARK OFFICE

CERTIFICATE OF CORRECTION

PATENT NO. : 5,470,639

DATED : November 28, 1995

INVENTOR(S) : Gessner et al.

It is certified that error appears in the above-identified patent and that said Letters Patent is hereby corrected as shown below:

Column 6, line 7, delete "G-652" and insert -- G-1652 --;

Columns 13-14, after "PERCENT RECOVERY" insert -- (%) --;

Column 17, line 3, delete "theremoplastic" and insert -- thermoplastic --;

Column 18, line 48, delete "means" and insert -- mean --;

Column 19, line 3, after "care" insert -- product --;

Column 19, line 6, after "care" insert -- product --;

Column 19, line 65, after "said" insert -- filaments --;

UNITED STATES PATENT AND TRADEMARK OFFICE

CERTIFICATE OF CORRECTION

PATENT NO. : 5,470,639

DATED : November 28, 1995

INVENTOR(S) : Gessner, et al

It is certified that error appears in the above-indentified patent and that said Letters Patent is hereby corrected as shown below:

Column 20, line 1, delete "32" and insert --42--;

Signed and Sealed this

Twenty-eighth Day of May, 1996

*Attest:*

BRUCE LEHMAN

*Attesting Officer*

*Commissioner of Patents and Trademarks*